US009010730B2

(12) United States Patent
Zhong et al.

(10) Patent No.: US 9,010,730 B2
(45) Date of Patent: Apr. 21, 2015

(54) DUAL-PURPOSE HYDRAULIC ELECTRIC JACK

(75) Inventors: Renzhi Zhong, Zhejiang (CN); Huajun Chen, Zhengjiang (CN)

(73) Assignee: Wenling Xinlei Air Compressor Co., Ltd., Wenling, Zhejiang (CN)

( * ) Notice: Subject to any disclaimer, the term of this patent is extended or adjusted under 35 U.S.C. 154(b) by 897 days.

(21) Appl. No.: 13/255,097

(22) PCT Filed: Jan. 21, 2010

(86) PCT No.: PCT/CN2010/070304
§ 371 (c)(1),
(2), (4) Date: Sep. 6, 2011

(87) PCT Pub. No.: WO2010/115354
PCT Pub. Date: Oct. 14, 2010

(65) Prior Publication Data

US 2011/0315940 A1 Dec. 29, 2011

(30) Foreign Application Priority Data

Apr. 9, 2009 (CN) ..... 2009 1 0301429

(51) Int. Cl.
*B66F 13/00* (2006.01)
*B66F 3/24* (2006.01)
*B66F 3/42* (2006.01)

(52) U.S. Cl.
CPC ..... *B66F 3/24* (2013.01)

(58) Field of Classification Search
USPC ..... 254/93 R, 93 H, 8 B, 419, 1, 89 H, 124, 254/2 B, 134; 269/32
See application file for complete search history.

(56) References Cited

U.S. PATENT DOCUMENTS

| | | | | | |
|---|---|---|---|---|---|
| 2,685,865 | A * | 8/1954 | D Haem et al. | ..... | 91/220 |
| 3,433,458 | A * | 3/1969 | Sano | ..... | 254/93 R |
| 4,131,263 | A * | 12/1978 | John | ..... | 254/8 B |
| 4,678,162 | A * | 7/1987 | Yang | ..... | 254/8 B |
| 4,678,164 | A * | 7/1987 | Yang | ..... | 254/93 H |
| 4,706,937 | A * | 11/1987 | Chung | ..... | 254/93 H |
| 5,445,505 | A * | 8/1995 | Hung | ..... | 417/374 |
| 5,447,026 | A * | 9/1995 | Stanley | ..... | 60/372 |
| 8,523,145 | B2 * | 9/2013 | Lancione et al. | ..... | 254/93 R |
| 2002/0083704 | A1 * | 7/2002 | Wang | ..... | 60/370 |

FOREIGN PATENT DOCUMENTS

WO PCT/CN2010/070304 4/2010

* cited by examiner

*Primary Examiner* — Lee D Wilson
*Assistant Examiner* — Seahee Yoon
(74) *Attorney, Agent, or Firm* — Global IP Services; Tianhua Gu

(57) ABSTRACT

A dual-purpose hydraulic electric jack comprises a hydraulic lifting mechanism (1, 2), an oil pump (12), an oil tank (9), an oil conveying pipeline and an electric motor (14). The lifting mechanism, the oil pump and the oil tank are all connected with the oil conveying pipeline. A transmission mechanism is arranged between the oil pump and the electric motor. A one-way valve (10) is provided between the oil tank and the oil pump. The oil pump (12) is equipped on one end side of the electric motor (14), and an air pump (15) is equipped on the other end side of the electric motor (14). A transmission mechanism is arranged between the air pump and the electric motor. The air pump is communicated with an air conveying pipeline (35) and the electric motor is equipped with a trigger mechanism for controlling the connection of the electric motor with the transmission mechanism between the electric motor and the air pump or oil pump. The function of the hydraulic electric jack is enhanced greatly and the hydraulic electric jack is convenient to use.

17 Claims, 4 Drawing Sheets

DUAL-PURPOSE HYDRAULIC ELECTRIC JACK

CROSS REFERENCE TO RELATED PATENT APPLICATION

The present application is the US national stage of PCT/CN2010/070304 filed on Jan. 21, 2010, which claims the priority of the Chinese patent application No. 200910301429.3 filed on Apr. 9, 2009, which application is incorporated herein by reference.

FIELD OF THE INVENTION

This invention relates to a special jack mechanism, particularly to a dual-purpose hydraulic electric designed for jacking vehicles droved by hydraulic oil jack.

BACKGROUND OF THE INVENTION

A broke down has always been part of driving, so jack will be a necessity for a driver, when he or she meets some broke down issues.

It is applied for an invention patent on hydraulic electric Jack for vehicles (patent number: 200620357377.8), this kind of jack is composed of oil tank, motor, oil pump, piston push rod, which are connected with each other by complicated oil pipelines, in which valve cavity shall be added. The inside of the valve cavity is divided into two parts by steel ball-shape one-way valve, the upper valve cavity and the lower valve cavity. Inside the valve cavity is a movable object, on which there is one ejector rod used for pushing the steel ball. When the jack works, the rotation direction of the motor decides the flow direction of the hydraulic oil in the valve cavity in order to keep the piston ejector rod moving accordingly. While the jack is different to produce and assemble during its actual producing, assembling and using process, and its stability is not good as well. Investigating its reason, it is due to the complicated structure in the valve cavity and higher request for the position and movement relations between each component inside the valve cavity, as well as the complicated structure of the oil pipeline connected to the valve cavity. What's more, this kind of jack lacks of versatile functions, and can't be used for other purpose.

SUMMARY OF THE INVENTION

In order to solve the said shortcomings of the existing dual-purpose hydraulic electric jack, the technical problems to be solved for this invention are: to offer a new style of dual-purpose hydraulic electric jack, which has simple structure and versatile functions.

In order to solve the technical problems mentioned above, the measures of this invention takes are: a new style of dual-purpose hydraulic electric jack, which consists of hydraulic jacking mechanism, oil pump, oil tank, oil pipeline and motor. The hydraulic jacking mechanism, oil pump and oil tank are all connected to the oil pipelines. Between the oil pump and the motor is assembled the first drive mechanism with a one-way valve between the oil tank and the oil pump. On one end of the motor is the said oil pump and a air pump positioned on the other end. Between the air pump and the motor is assembled the second drive mechanism, and the air pump is connected to the air pipe. At the location of the motor is a pull mechanism, which is assembled to control the drive mechanism between the motor and the air pump or the oil pump. The pull mechanism can control the motor to connect to air pump or oil pump, but the air pump and oil pump can't be working at the same time. When the motor drives the oil pump, the hydraulic oil will be pumped into the oil cylinder in the jacking mechanism from the oil tank, and then it can't flow back into the tank due to the one-way valve. So the increasing hydraulic oil in the jacking mechanism will push the jacking mechanism to lift the heavy object. When the drive mechanism works between the motor and the air pump, the motor will drive the air pump to work to supply compressed air, which can be used for the air inflation for vehicles.

As the preferred alternative, the said air pipeline has a air cock, which is provided with exhausting duct and inflatable duct. The air inlets of both ducts are connected to the said air pipeline, and the air outlets are both connected to each other.

The exhausting valve is assembled between the inlet and outlet of exhausting duct, while a T-shape air bar is assembled between the inlet and outlet of inflatable duct. The air cock can be used for air inflation for vehicle tires, which increases the scope of application of the jack. The stretch end of the exhausting valve props up the relevant interface in the exhausting duct. When the pressure of the compressed air gets higher in the air pipe, the air will press the exhausting valve open to enter the inflatable duct, then the air pump will start working, while the T-shape air bar will fit the relevant interface in the exhausting duct as well. When the air inflation begins, the air cock will fit the inflation cock in the vehicle tire first, and then the air bar is pushed away from the interface of the inflatable duct, finally the compressed air could smoothly enter the vehicle tire.

The said air pump and oil pump are connected to their relevant connection bases that are linked with each other, while the motor is assembled and can slip well on a coupling bar. By operating the pull mechanism, the motor can selectively slip to the air pump or the oil pump to drive it.

As the preferred alternative, the end of the said motor has a connection board that interstitially hitches the coupling bar. While the said pull mechanism is assembled on the oil pump base or the air pump base. Connected with the coupling bar, meanwhile the motor could move by the connection board on the motor, making its structure simple and easy to operate.

As the preferred alternative, the said pull mechanism is assembled on the connection base of the air pump, but there is only such one connection board close to the connection base of the oil pump. The coupling bar is hitched by a backspring assembled between the connection board and the connection base of the oil pump. The slipping direction of the motor on the coupling bar can be controlled by their cooperation between the backspring and the pull mechanism, making the structure simple.

As the preferred alternative, the pull mechanism has a knob on the connection base of the air pump and one rotatable block assembled inside the connection base of the air pump, which is linked with the knob, as well as a driving mechanism assembled outside of the rotatable block, which can touch the circumferential outside interface of the rotatable block. The driving mechanism can push the motor to the connection base of the oil pump as the circumferential outside interface of the rotatable block slips on it. When the rotatable block turns, its circumferential outside interface could change the position of the motor on the coupling bar.

As the preferred alternative, the rotatable block has a sector cross section, and the said driving mechanism has one driving spring, which hitches on the coupling bar, as well as one slurcork that can slip on the coupling bar. One end of the driving spring presses on the connection board, and the other on the slurcork that could touch the outside circumferential interface of the said rotatable block; on the connection base of the air pump is a limit bolt, whose end could reach the rotation range of the rotatable block. The stability of the motor can be improved by the driving spring during the slipping process, making it easy to connect to the drive mechanism. The rotation angle of the rotatable block can be set by the limit bolt to keep the position of the moved motor on the coupling bar, which can ensure the stability of the power transmission for the drive mechanism.

As the preferred alternative, the drive mechanism has one projecting insert on the connection base of the air pump or the oil pump, and a slot in the relevant position of the motor end. The insert bears on the end of the motor, could interstitially get in the slot, and its length is consistent with the max moveable displacement of the motor on the coupling bar. The power transmission could be finished by the cooperation between the insert and the slot, offering a simple structure and nice transmission stability.

As the preferred alternative, the end of the insert closed to the motor is sharp pointed, which could promote the inserting operation between the insert and the slot and improve the stability of the jack during its working process.

As the preferred alternative, the jacking mechanism is assembled with some overload protection on it. When the heavy object is lifted to come to a head, the protection could control the motor to stop working in order to protect the oil pump.

Accordingly, the advantages of this invention are:

As the air pump is assembled, it could be driven by the motor to offer the vehicle tires compressed air for air inflation, which improves the application range of the jack. The pull mechanism can be used to control the connection between the motor and the oil pump or air pump to ensure their working condition and the reliability of the jack.

DETAILED DESCRIPTION OF THE INVENTION

Figure 1:
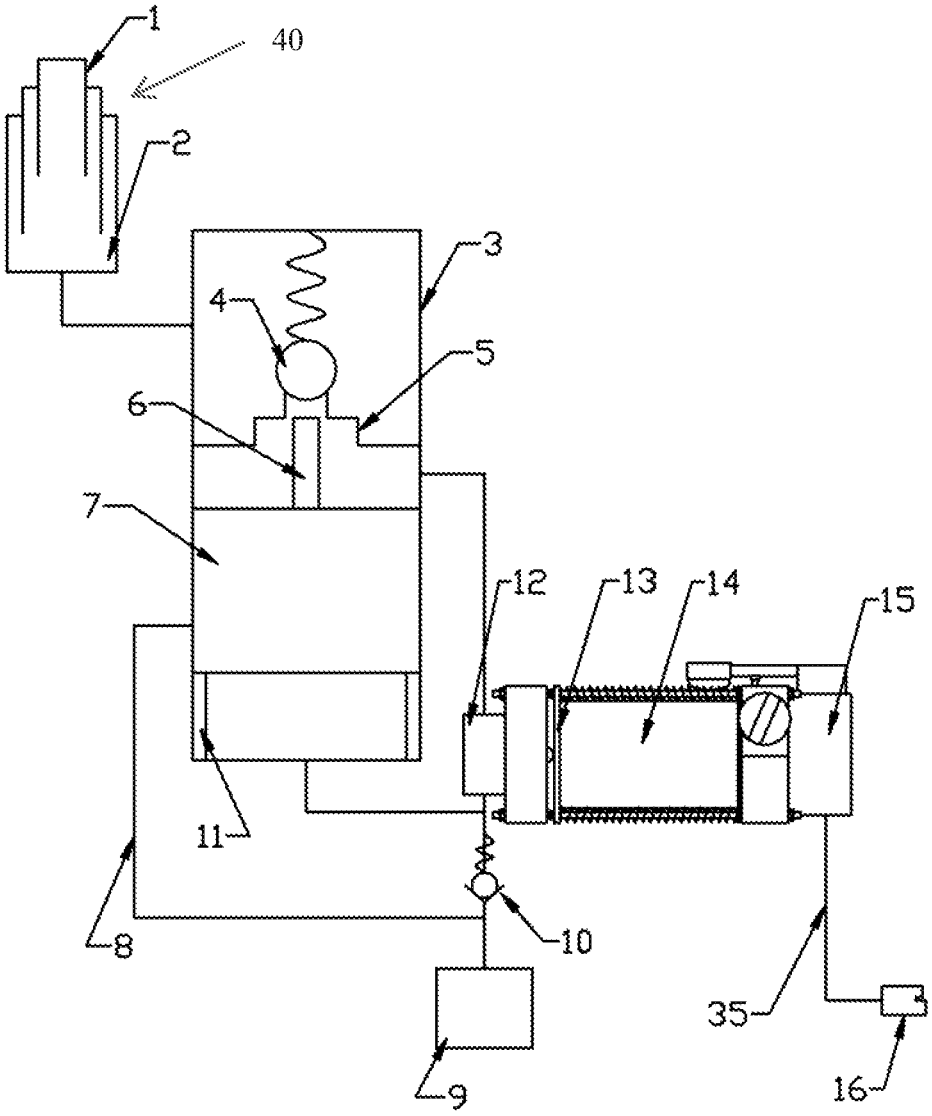
FIG. 1 is the perspective view of the dual-purpose hydraulic electric jack construction proposed by the present invention.
Figure 2:
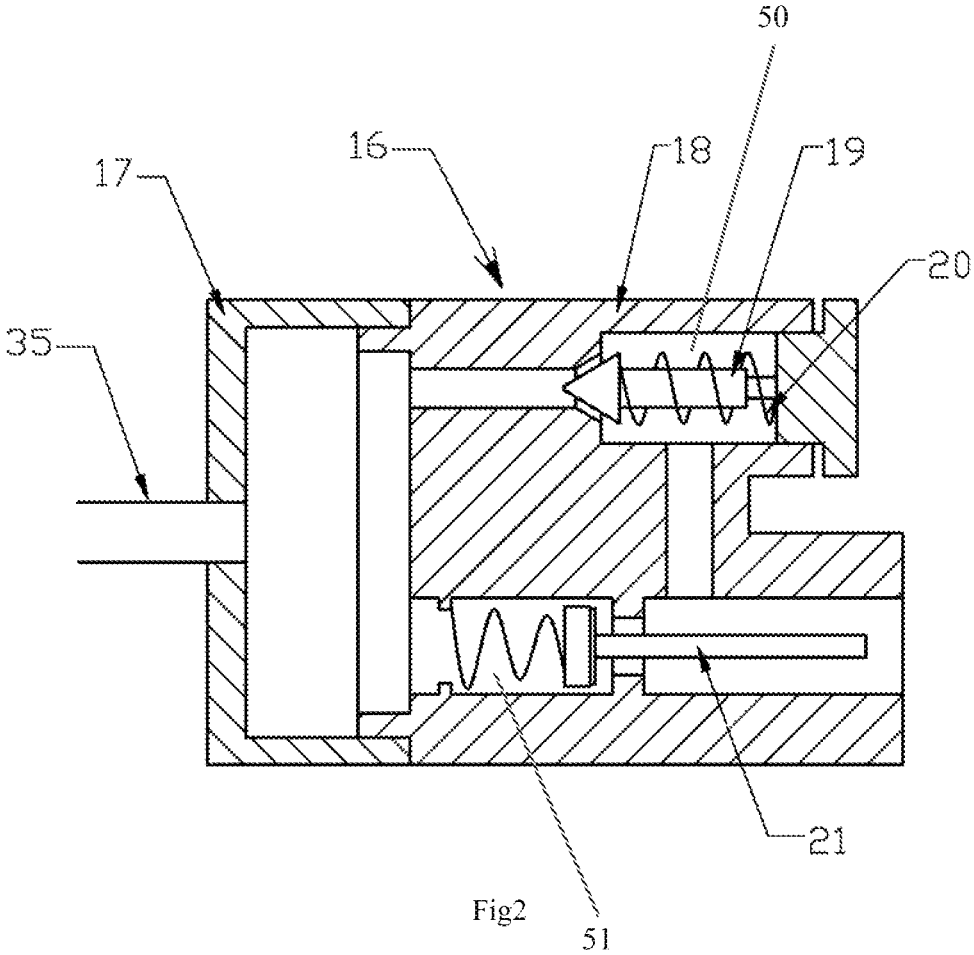
FIG. 2 is the amplificatory longitudinal section view of the air cock.
Figure 3:
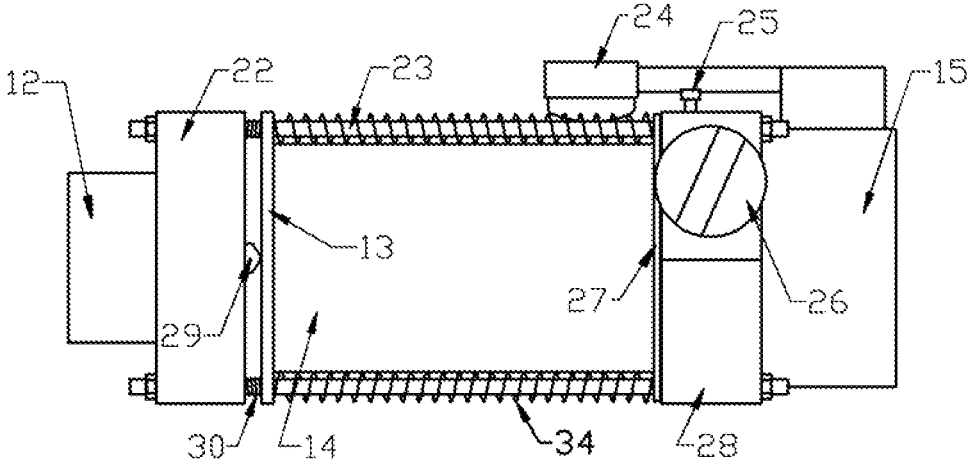
FIG. 3 is the perspective view of the oil pump, motor and air pump when they are connected together and the power is transmitted to air pump from the motor.
Figure 4:
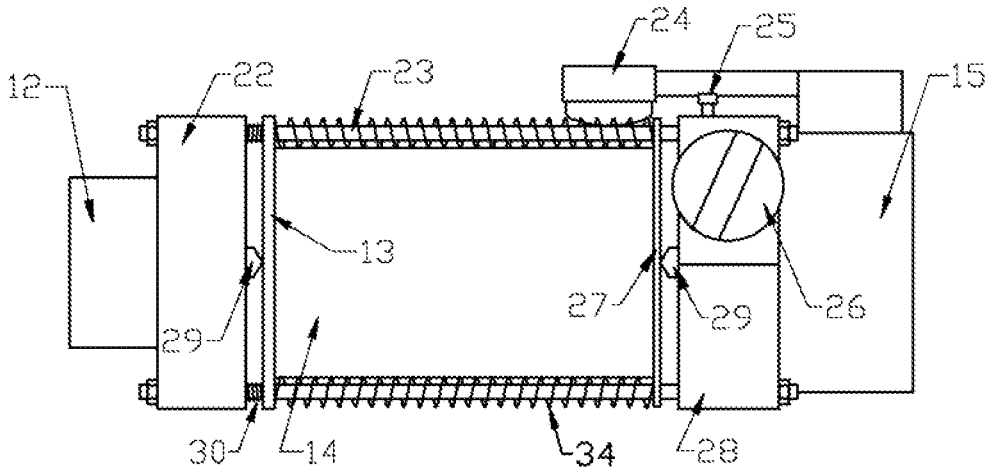
FIG. 4 is the incompact perspective view of the oil pump, motor and air pump when they are connected together and no power is transmitted to air pump or oil pump from the motor.
Figure 5:
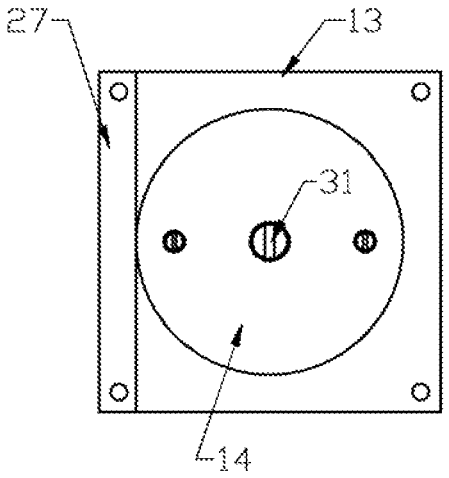
FIG. 5 is the end face perspective view of the motor side closed to the air pump.
Figure 6:
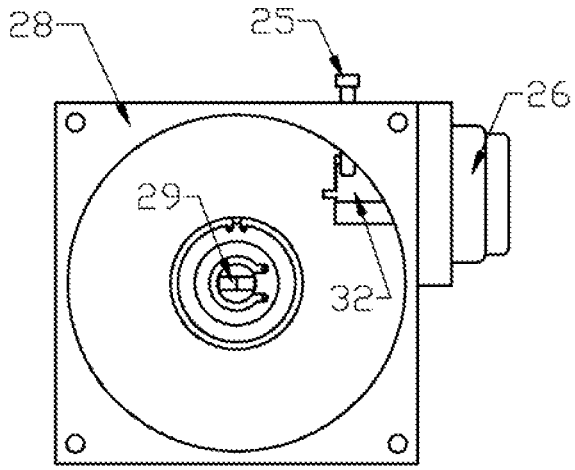
FIG. 6 is the end face perspective view of the connection base with air pump.
Figure 7:
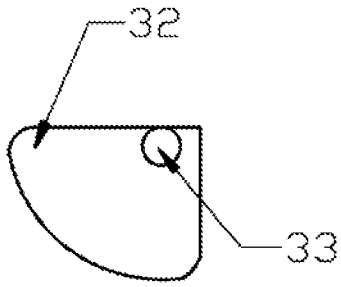
FIG. 7 is the perspective view of the rotatable block.
Figure 8:
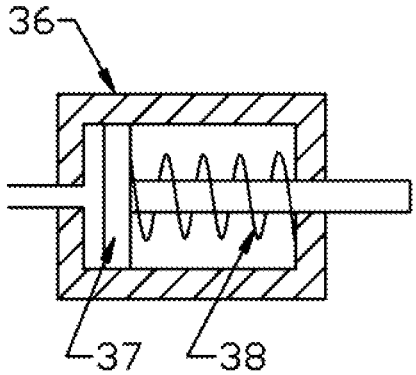
FIG. 8 is the perspective view of the overload protection mechanism.

As shown in FIG. 1, the dual-purpose hydraulic electric jack, proposed by the present invention, is comprised of hydraulic jacking mechanism 40, oil pump 12, oil tank 9 and motor 14, all of which are connected to the oil pipeline, but the motor 14. The said oil pump is gear oil pump, and the motor is permanent magnet DC motor.

The jacking mechanism is comprised of ejector rod 1 and oil cylinder 2, and the ejector rod 1 is a two-stage construction in the oil cylinder 2. Between the oil pump 12 and the oil cylinder 2 is assembled a one-way control valve 3 that has a partition 5 inside, and the one-way control valve 3 is divided into two parts: oil entering cavity and oil returning cavity, both of which are connected to the oil hole in the partition 5. In the oil entering cavity near the oil hole is one steel ball 4, which can block off the mouth of the oil hole. Between the steel ball 4 and the one-way control valve is one spring connected with them. The oil pipeline joins the oil pump 12 and the oil cylinder 2, successively connecting oil pump 12, oil returning cavity, oil hole, oil entering cavity and oil cylinder 2. In the oil returning cavity there is a movable object 7, which has a thimble on its end near the steel ball 4. The thimble 6 is corresponding with the position of the oil hole, and its diameter is less than the oil hole diameter. So that the thimble 6 can insert the oil hole in order to push the steel ball 4 away. The oil returning cavity is divided into upper oil cavity and lower oil cavity by the movable object 7, and the thimble 6 is assembled in the upper oil cavity struck by the oil pipeline. Between the oil tank 9 and the lower oil cavity of the one-way control valve is assembled some oil returning pipeline 8, and at the bottom of the lower oil cavity is assembled stage 11, on which the moveable object 7 will get to cover the oil entrance in the oil returning pipeline 8 when the jacking mechanism is working. Between the oil pump 12 and the oil tank 9 is assembled one-way valve 10 in the oil pipeline.

When the jacking mechanism works in the jack, the hydraulic oil is pumped from the oil tank 9 by the oil pump and gets into the upper oil cavity of the oil returning cavity through the one-way valve 10, and then it pushes the said steel ball 4 away, finally go through the oil entering cavity and enter in the oil cylinder 2 to drive the ejector rod to jack the heavy object. When the heavy object gets the right place, the motor 14 stops working, and the steel ball 4 covers the oil hole under the pressure of the hydraulic oil, then the hydraulic oil will keep still in the oil cylinder 2 and the oil-entering cavity, so the heavy object will be kept at the certain height. When the heavy object slowly falls, the motor 14 will take contra rotation, while the hydraulic oil in the upper oil cavity will not flow back into the oil tank 9 through the oil pipeline between the oil pump 12 and oil tank 9, but into the said lower oil cavity as result of the one-way valve 10 under the pressure of the oil pump 12. Along with the decrease of the hydraulic oil in the upper oil cavity, the hydraulic oil will push the moveable object 7 to the partition 5, then the thimble 6 will push the steel ball 4 away, so that the working hydraulic oil could flow back to the upper oil cavity through the clearance between the steel ball 4 and the oil hole. When the moveable object moves some certain distance, the oil entrance of the said oil returning pipeline will be revealed, then the hydraulic oil will go back into the oil tank 9 through the oil pipeline to reduce the height of the heavy object. While it has strict demand of the position of the oil entrance of oil returning pipeline 8 on the one-way control valve 3 wall, it is that the distance between the oil entrance and the stage 11 shall be slightly longer than that between the end of thimble 6 and the steel ball 4. So that the thimble 6 can fully push the steel ball 4 away during the oil returning process to ensure the hydraulic oil can flow back smoothly through the oil returning pipeline.

An overload protection is also added into the said jacking mechanism. It includes a mechanical part, which is connected to the one-way control valve 3, and a commutation switch, which is connected to the control circuit of the motor 14. For the mechanical part, it can be assembled on the one-way control valve 3 or kept separately. The mechanical part is comprised of the casing 36 and the T-shape piston 37 in the casing 36, as well as the pressure spring 38 between them. On the piston 37 is the ejector rod protruding from the casing 36, and the casing 36 is connected to the said oil returning cavity of the one-way control valve 3 through the oil pipeline. The said commutation switch is assembled in the control circuit of the motor 14, when the heavy object is jacked up to the top point, the hydraulic oil pressure will go up in the oil returning cavity, if the oil pump keeps on working driven by the motor, as the casing 36 is connected to the oil returning cavity, so the hydraulic oil will push the piston 37 to overcome the elasticity derived from the spring 38, then the ejector rod on the piston 37 will touch the commutation switch to cut the control circuit off and stop the motor 14. When the heavy object needs to fall, the motor 14 will go reversal by the control switch, and then the heavy object will fall. The commutation switch and the control switch can be used to realize forward rotation, reversal and brake control. However, it must be noted that the elasticity, loading on the piston 37 from the pressure spring 38, shall be slightly greater than the pressure on the piston 37 from the hydraulic oil when the heavy object is jacked to the top point, this can be easily obtained by testing. One end of the motor is assembled the oil pump 12, and the other end is air pump 15, meanwhile both of the pumps have drive mechanism connected to the motor for power transmission. At the location of the motor 14 is a pull mechanism, which shall be assembled to control the connection between the motor and the air pump or the oil pump, while the air pump and oil pump can't get working at the same time. The said air pump and oil pump are connected to each relevant massive connection base that is linked with each other by four coupling bars 23. The end of the motor has a connection board 13 near the connection base of the oil pump 22, and there are through holes at the four corners of the motor, which are inserted by coupling bars. In this way, a combination forms, which is comprised of the oil pump 12 with its connection base 22, air pump 15 and its connection base 28, as well as the motor 14, while the motor 14 is situated in the middle of the combination with the two pumps situated on the either side. What is more, the motor 14 can axially slip to the air pump 15 or the oil pump 12 along a coupling bar 23.

The said pull mechanism is assembled on the flank of the connection base 28 of the air pump, which has a knob 26 on its outside and an eccentric rotatable block 32 inside the connection base of the air pump. One end of the rotatable block 32 is connected with knob 26, and the other is a shaft 33, which is on the connection base of the air pump 28, and the knob 26 can drive the rotatable block to rotate together. The rotatable block has a cross section sector. On the connection base of the air pump 28 is assembled the limit bolt 25, whose end could reach the rotation range of the rotatable block. When the rotatable block 32 rotates, both of the upper flanks can touch the limit bolt, so that the two positions of the rotatable block 32 can be limited.

Outside of the rotatable block 32 is assembled the driving mechanism that can touch the circumferential outside interface of the rotatable block 32. The driving mechanism can push the motor to the connection base of the oil pump 22 when the circumferential outside interface of the rotatable block slips on it. The said driving mechanism has one driving spring 34, which is hitches on the coupling bar 23, as well as one slurcork 27 that can slip on the coupling bar 23, and one end of the driving spring can press the said connection board 13, while the other for the slurcork 27 that could touch the outside circumferential interface of the said rotatable block. The said driving mechanism can also be one thrust pole, which is on the end of the motor 14 near the connection base of the air pump. The structure of the thrust pole is one bolt, whose position is corresponding with the position of the rotatable block 32, and its outer end can touch the camber cylinder of the rotatable block 32. When the rotatable block rotates, the thrust pole will slip on the camber cylinder of the rotatable block 32. The thrust pole is assembled on the motor 14 and could move, that is the thrust pole can move axially on the motor 14, and is hitched by the screw spring that presses on both the motor 14 and the thrust pole.

On the coupling bar 23 is a backspring 30, which is equipped between the connection board 13 and the connection base of the oil pump 22. Meanwhile the backspring elasticity shall be less than the elasticity of the screw spring and the driving spring 34, that is when the rotatable block 32 rotates, it will press the thrust pole or the slurcork 27 to force the motor 14 by the screw spring or driving spring 34, and overcome the elasticity from the backspring 30, finally promote the motor to slip to the oil pump. When the motor 14 reverses, the pressure will relieve on the driving pole or slurcork 27 from the rotatable block 32, and the motor 14 moves to the air pump 15 under the elasticity of the backspring 30. When the motor 14 moves to the oil pump 12 or air pump 15, it will connect to the relevant pump to realize its power transmission from the motor 14 to the relevant pump.

The said drive mechanism above has one projecting insert 29 on the connection base of the air pump 28 or the connection base the oil pump 22, and one slot in the end centre position of the motor 14. The insert 29 can reach to the outside of the connection base of the air pump 28 or the connection base of the oil pump 22, and has a sharp point, which can get in the said slot 31 when the motor 14 moves like above to realize its power transmission from the motor 14 to the air pump 14 or oil pump 12 that can be driven by the motor 14. The projecting length of the insert 29 fits to the max moveable displacement of the motor 14 on the coupling bar 23, that is the max moveable displacement of the motor 14 is slightly longer than the projecting length of the insert 29. The motor 14 is connected to the air pump 15 and oil pump 12 by the pull mechanism. The max moveable displacement of the motor 14 on the coupling bar 23 depends on the shape and size of the rotatable block 32.

The air pump 15 has been assembled with air pipeline 35. While one end of the air pipeline is assembled with the air cock 16, which is a connected detachable structure and comprised of the air cock body 18, as well as the concave adapter connector 17 that is connected to the air pipeline 35. Inside the air cock body 18 are assembled the exhaust pipe and inflation pipe, whose air inlets are both connected with the air pipeline 35 and air outlets are connected to each other. The exhaust pipe has one exhausting valve 19, which is between the air inlet and the air outlet, and one stage structure, to which the taper end of the exhausting valve is fitted. On the other end of the exhausting valve 19 is assembled the spring 20, under its elasticity, the exhausting valve 19 will have a tight fit to the exhaust pipe 19 when the compressed air is only a little in the air pipeline 35. Normally the elasticity of the spring 20 shall be slightly greater than the pressure in the air cylinder 9 on state, so that the compressed air could push the exhausting valve 19 open to vent outside through the exhaust pipe when the air cylinder 9 completes its working. Between the air inlet and the air outlet is assembled a T-shape air bar 21 and a relevant stage in the inflation pipe, the T-shape air bar could slip axially along the inflation pipe. If the air pipeline 35 is filled with compressed air, the compressed air will press the air bar 21 to have a tight fit with the stage interface in the inflation pipe. While the air cock 16 fits the inflation in the vehicle tire, the air bar will be pushed an axial displacement by the inflation valve, so as to offer a clearance between the air bar 21 and the said stage interface, through which the compressed air could flow in the vehicle tire.

In order to quantitatively show the working condition of the air pump 15, the air pump 15 is assembled with a air manometer 24, which could show the pressure of the compressed air derived from the air pump 15, so as to avoid a blowout during the air inflating process.

When the dual-purpose hydraulic electric jack is working, the motor can be controlled by the three-state controller, which has three keys as "Up", "Down" and "Pause". The "Up" key could be series-wound with some control circuit of the motor 14 for forward rotation; while the "Down" key could be series-wound with other control circuit of the motor 14 for the contra rotation; and the last "Pause" key can be used to cut off the power of the motor 14. Furthermore, the said "Down" key could also be used as the control key for inflation, or assemble another "Inflation" key, which can be parallel with the "Down" in the controller. When the motor 14 is connected with the air pump 15 by the pull mechanism, the motor 14 will take contra rotation if the "Inflation" key is pressed, so as to drive the air pump 15 to offer compressed air.

What is claimed is:

1. A dual-purpose hydraulic electric jack comprising:

a hydraulic jacking mechanism, an oil pump, an oil tank, oil pipes and a motor;

the hydraulic jacking mechanism, the oil pump, the oil tank are linked to the oil pipes, a first drive mechanism is equipped between the oil pump and the motor, a one-way valve is set between the tank and the oil pump; wherein the oil pump (12) is positioned on one side of the motor (14) and an air pump is positioned on another side of the motor(14), a second drive mechanism is set with the air pump(15) and the motor (14), the air pump(15) is connected to an air pipe(35), a pull mechanism is mounted with the motor(14) to control the connection of the motor to the drive mechanism between the air pump(15) and the oil pump(12);

the air pump (15) is assembled to a connection base of air pump (28), the oil pump (12) is assembled to a connection base of oil pump (22), and both bases are connected by a coupling bar (23), the motor (14) is assembled slide-ably to the coupling bar (23).

2. The dual-purpose hydraulic electric jack according to claim 1, wherein there is a air cock connected with the air pipe (35), the cock (16) is provided with an exhausting duct (50) and an inflatable duct (51), air inlets of both ducts are connected to the air pipe, outlets of both ducts are connected to each other, a exhausting valve is mounted between the inlet and the outlet of the exhausting duct while a T-shape air bar is mounted between the inlet and the outlet of the inflatable duct.

3. The dual-purpose hydraulic electric jack according to claim 1, wherein an end of the motor (14) has a connection board (13) that is connected to and hitches on the coupling bar (23) with some clearance, the pull mechanism is fixed on the connection base of the oil pump (22) or the connection base of the air pump (28).

4. The dual-purpose hydraulic electric jack according to claim 3, wherein the pull mechanism is assembled on the connection base of the air pump (28), and the connection board (13) is close to the connection base of the oil pump (22), a back spring (30) is on the coupling bar (23) between the connection board (13) and the connection base of the oil pump (22).

5. The dual-purpose hydraulic electric jack according to claim 4, wherein the pull mechanism has a knob (26) on the connection base of air pump (28), a rotatable block is assembled inside the connection base of air pump (28), the knob (26) is connected with the rotatable block, a driving mechanism assembled beside the rotatable block (32) can touch a circumferential outside interface of the rotatable block (32), the driving mechanism pushes the motor (14) to the connection base of the oil pump (22) when the circumferential outside interface of the rotatable block slides on the driving mechanism.

6. The dual-purpose hydraulic electric jack according to claim 5, wherein the rotatable block (32) has a sector cross section, the driving mechanism has a driving spring (34) on the coupling bar (23) as well as a slurcork (27) that can slip on the coupling bar (23), one end of the driving spring presses on the connection board (13) and the other end pushes the slurcork (27) to touch the outside circumferential interface of the rotatable block (32), on the connection base of the air pump (28) is a limit bolt (25), whose end reaches the rotation range of the rotatable block(32).

7. The dual-purpose hydraulic electric jack according to claim 3, wherein the drive mechanism includes one projecting insert (29) on the connection base of air pump (28) or the connection base of oil pump (28), and one slot (31) in the relevant end position of the motor (14), the insert (29) bears on the end of the motor (14), could loosely get in or out the slot (31), and a length of the insert is consistent with the max moveable displacement of the motor (14) on the coupling bar (23).

8. The dual-purpose hydraulic electric jack according to claim 7, wherein the end of the insert (29) closed to the motor (14) is sharp pointed.

9. The dual-purpose hydraulic electric jack according to claim 1, wherein the hydraulic jacking mechanism has overload protection means.

10. The dual-purpose hydraulic electric jack according to claim 2, wherein the air pump (15) is assembled to a connection base of the air pump (28), the oil pump (12) is assembled to a connection base of the oil pump (22), and both bases are connected by a coupling bar (23), the motor (14) is assembled slide-ably to the coupling bar (23).

11. The dual-purpose hydraulic electric jack according to claim 10, wherein an end of the motor (14) has a connection board (13) that is connected to and hitches on the coupling bar (23) with some clearance, the pull mechanism is fixed on the connection base of the oil pump (22) or the connection base of the air pump (28).

12. The dual-purpose hydraulic electric jack according to claim 11, wherein the pull mechanism is assembled on the connection base of the air pump (28), and the connection board (13) is close to the connection base of the oil pump (22), a back spring (30) is on the coupling bar (23) between the connection board (13) and the connection base of the oil pump (22).

13. The dual-purpose hydraulic electric jack according to claim 12, wherein the pull mechanism has a knob (26) on the connection base of the air pump (28), a rotatable block is assembled inside the connection base of the air pump (28), the knob (26) is connected with the rotatable block, a driving mechanism assembled beside the rotatable block (32) can touch a circumferential outside interface of the rotatable block (32), the driving mechanism pushes the motor (14) to the connection base of the oil pump (22) when the circumferential outside interface of the rotatable block slides on the driving mechanism.

14. The dual-purpose hydraulic electric jack according to claim 13, wherein the rotatable block (32) has a sector cross section, the driving mechanism has a driving spring (34) on the coupling bar (23) as well as a slurcork (27) that can slip on the coupling bar (23), one end of the driving spring presses on the connection board (13) and the other end pushes the slurcork (27) to touch the outside circumferential interface of the rotatable block (32), on the connection base of the air pump (28) is a limit bolt (25), whose end reaches the rotation range of the rotatable block(32).

15. The dual-purpose hydraulic electric jack according to claim 11, wherein the drive mechanism includes one projecting insert (29) on the connection base of the air pump (28) or the connection base of the oil pump (28), and one slot (31) in the relevant end position of the motor (14), the insert (29) bears on the end of the motor (14), could loosely get in or out the slot (31), and a length of the insert is consistent with the max moveable displacement of the motor (14) on the coupling bar (23).

16. The dual-purpose hydraulic electric jack according to claim 15, wherein the end of the insert (29) closed to the motor (14) is sharp pointed.

17. The dual-purpose hydraulic electric jack according to claim 2, wherein the hydraulic jacking mechanism has overload protection means.

* * * * *